US012498167B2

(12) United States Patent
Burgan et al.

(10) Patent No.: US 12,498,167 B2
(45) Date of Patent: Dec. 16, 2025

(54) REFRIGERATOR INTERIOR LAYOUT

(71) Applicant: Electrolux Home Products, Inc., Charlotte, NC (US)

(72) Inventors: Ricky Burgan, Mauldin, SC (US); Marcello Machado, Anderson, SC (US); Eduardo Orthmann, Curitiba (BR); Danilo Goncalves, Curitiba (BR)

(73) Assignee: Electrolux Consumer Products, Inc., Charlotte, NC (US)

( * ) Notice: Subject to any disclaimer, the term of this patent is extended or adjusted under 35 U.S.C. 154(b) by 402 days.

(21) Appl. No.: 17/955,823

(22) Filed: Sep. 29, 2022

(65) Prior Publication Data

US 2024/0110745 A1 Apr. 4, 2024

(51) Int. Cl.

| | |
|---|---|
| ***F25D 23/12*** | (2006.01) |
| ***F25D 17/04*** | (2006.01) |
| ***F25D 23/06*** | (2006.01) |

(52) U.S. Cl.

CPC ..... *F25D 23/126* (2013.01); *F25D 17/04* (2013.01); *F25D 23/066* (2013.01); *F25D 2201/126* (2013.01); *F25D 2323/121* (2013.01); *F25D 2323/122* (2013.01)

(58) Field of Classification Search

CPC .. F25D 2201/126; F25D 17/04; F25D 23/066; F25D 17/06–17/08; F25D 23/126; F25D 23/068; F25D 2323/121; F25D 2323/122

See application file for complete search history.

(56) References Cited

U.S. PATENT DOCUMENTS

| | | | |
|---|---|---|---|
| 3,511,415 | A | 5/1970 | Crowe |
| 3,834,178 | A | 9/1974 | Pink |
| 4,036,620 | A | 7/1977 | Benasutti |
| 4,739,629 | A | 4/1988 | True |
| 5,315,845 | A | 5/1994 | Lee |
| 5,542,264 | A | 8/1996 | Hortin |
| 6,079,221 | A | 6/2000 | Senner |
| 7,269,968 | B2 | 9/2007 | Harder |
| 7,287,397 | B2 | 10/2007 | Coulter |

(Continued)

FOREIGN PATENT DOCUMENTS

| | | |
|---|---|---|
| CN | 1766483 | 5/2006 |
| DE | 102018212564 | 2/2019 |

(Continued)

OTHER PUBLICATIONS

International Search Report for PCT/US2023/032368 dated Dec. 11, 2023, 15 pages.

*Primary Examiner* — Cassey D Bauer

(74) *Attorney, Agent, or Firm* — Chrisman Gallo Tochtrop LLC

(57) ABSTRACT

An interior layout for a refrigerator appliance features an interior liner defining a recess for a water tank, and an air tower assembly defining a space for the water tank laterally outside the air plenum of the air tower assembly. The water tank is arranged in the recess and secured to the liner with a mounting bracket. The air tower assembly includes insulation and an air tower cover. The insulation defines an opening that is dimensionally aligned with the recess and partially receives the water tank therein. The air tower cover is disposed about the insulation and conceals the water tank.

18 Claims, 10 Drawing Sheets

(56) References Cited

U.S. PATENT DOCUMENTS

| | | | |
|---|---|---|---|
| 7,568,357 | B2 | 8/2009 | Jenkins |
| 7,603,869 | B2 | 10/2009 | Kim |
| 7,850,898 | B1 | 12/2010 | Rowley |
| 8,020,403 | B2 | 9/2011 | Rotter |
| 8,028,534 | B2 | 10/2011 | Jenkins |
| 8,431,067 | B2 | 4/2013 | Rowley |
| 8,640,481 | B2 | 2/2014 | An |
| 8,726,685 | B2 | 5/2014 | An |
| 8,833,100 | B2 | 9/2014 | Meyerholtz |
| 8,938,985 | B2 | 1/2015 | Lim |
| 8,980,161 | B2 | 3/2015 | Rowley |
| 9,170,040 | B2 | 10/2015 | An |
| 9,360,239 | B2 | 6/2016 | Lim |
| 9,494,362 | B2 | 11/2016 | Lim |
| 9,631,859 | B2 | 4/2017 | Park |
| 9,709,321 | B2 | 7/2017 | Yang |
| 10,088,217 | B2 | 10/2018 | Baeuerle |
| 10,422,574 | B1 | 9/2019 | Gardner |
| 10,480,841 | B2 | 11/2019 | An |
| 10,775,092 | B2 | 9/2020 | Wetekamp |
| 10,976,093 | B2 | 4/2021 | Casanova |
| 2007/0074529 | A1 | 4/2007 | Lim |
| 2009/0126390 | A1 | 5/2009 | Park |
| 2009/0193834 | A1 | 8/2009 | Buchstab et al. |
| 2014/0157810 | A1 | 6/2014 | Jang |
| 2015/0096323 | A1 | 4/2015 | Lim |
| 2015/0203344 | A1* | 7/2015 | Buchstab ..... F25D 25/005 62/419 |
| 2017/0292737 | A1 | 10/2017 | Moon |
| 2018/0120016 | A1* | 5/2018 | Maxwell ..... F25D 17/065 |
| 2020/0378675 | A1 | 12/2020 | Wetekamp |

FOREIGN PATENT DOCUMENTS

| | | |
|---|---|---|
| JP | 2002318068 | 10/2002 |
| KR | 20020013331 | 2/2002 |
| KR | 100592669 | 6/2006 |
| KR | 20140123739 | 10/2014 |
| KR | 20180112265 | 10/2018 |
| KR | 20200122715 | 10/2020 |
| KR | 20210076354 | 6/2021 |

* cited by examiner

REFRIGERATOR INTERIOR LAYOUT

FIELD OF THE INVENTION

This application generally relates to the architectural layout of a refrigerator appliance, and more particularly, a novel interior layout including a liner and an air tower assembly that optimize the space efficiency of the appliance.

BACKGROUND

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Many refrigerator appliances also include a water tank and valve assembly for selectively supplying water to a water dispenser in response to a user command. In some appliances, the water tank and valve assembly are arranged inside the refrigerator compartment (e.g., adjacent to a vegetable crisper assembly) or in a space adjacent to the rear wall and the ceiling of the appliance. Arranging a water tank and valve assembly in such locations undesirably diminishes the space efficiency (i.e., usable space) of the appliance since it is necessary to design and/or reserve a large discrete area therefor. Thus, it is desirable to provide a new interior layout for accommodating a water tank that does not diminish the space efficiency of the refrigerator appliance.

BRIEF SUMMARY

The following presents a simplified summary of the disclosure in order to provide a basic understanding of some example aspects described in the detailed description. This summary is not an extensive overview. Moreover, this summary is not intended to identify critical elements of the disclosure nor delineate the scope of the disclosure. The sole purpose of the summary is to present some concepts in simplified form as a prelude to the more detailed description that is presented later.

In accordance with one aspect, there is provided a refrigerator appliance including a liner and an air tower assembly. The liner bounds a storage compartment and defines a recess, and the air tower assembly includes insulation and a cover. The insulation is disposed about the liner and defines an air plenum therein. The appliance also includes a dispenser for selectively dispensing water, and a water tank assembly is mounted in the recess of the liner. The water tank assembly is adapted to supply water to the dispenser, and the air plenum defines a channel therein. The channel is in fluid communication with the recess of the liner and is configured to direct air toward the water tank assembly.

In accordance with another aspect, there is provided a refrigerator appliance including a liner defining a first storage compartment and a second storage compartment. The first storage compartment is bounded by a rear wall, a first side wall, and a second side wall, and the rear wall defines a recess therein. The appliance also includes an air tower assembly with foam insulation and a cover. The foam insulation is disposed about the rear wall and defines a first opening therethrough aligned with the recess. A dispenser is attached to one of the first and second side walls. A water tank assembly is mounted in the recess of the rear wall. The water tank assembly is at least partially arranged in the first opening of the foam insulation and is adapted to supply water to the dispenser. A valve assembly is disposed outside the second storage compartment, and a water filter assembly is arranged in the first storage compartment.

In accordance with yet another aspect, there is provided a refrigerator appliance including a liner and an air tower assembly. The liner bounds a storage compartment and defines a recess, and the air tower assembly includes insulation and a cover. The insulation is disposed about the liner and defines a first opening therethrough aligned with the recess of the liner. The appliance also includes a dispenser for selectively dispensing water and water tank assembly adapted to supply water to the dispenser. The water tank assembly is mounted in the recess and is at least partially arranged in the opening of the insulation.

It is to be understood that both the foregoing general description and the following detailed description present embodiments of the present disclosure, and are intended to provide an overview or framework for understanding the nature and character of the embodiments as they are described and claimed. The accompanying drawings are included to provide a further understanding of the embodiments, and are incorporated into and constitute a part of this specification. The drawings illustrate various embodiments of the disclosure and together with the description serve to explain the principles and operations thereof.

BRIEF DESCRIPTION OF THE DRAWINGS

These and other features, aspects and advantages of the present disclosure can be further understood when read with reference to the accompanying drawings.

DETAILED DESCRIPTION

Figure 1:
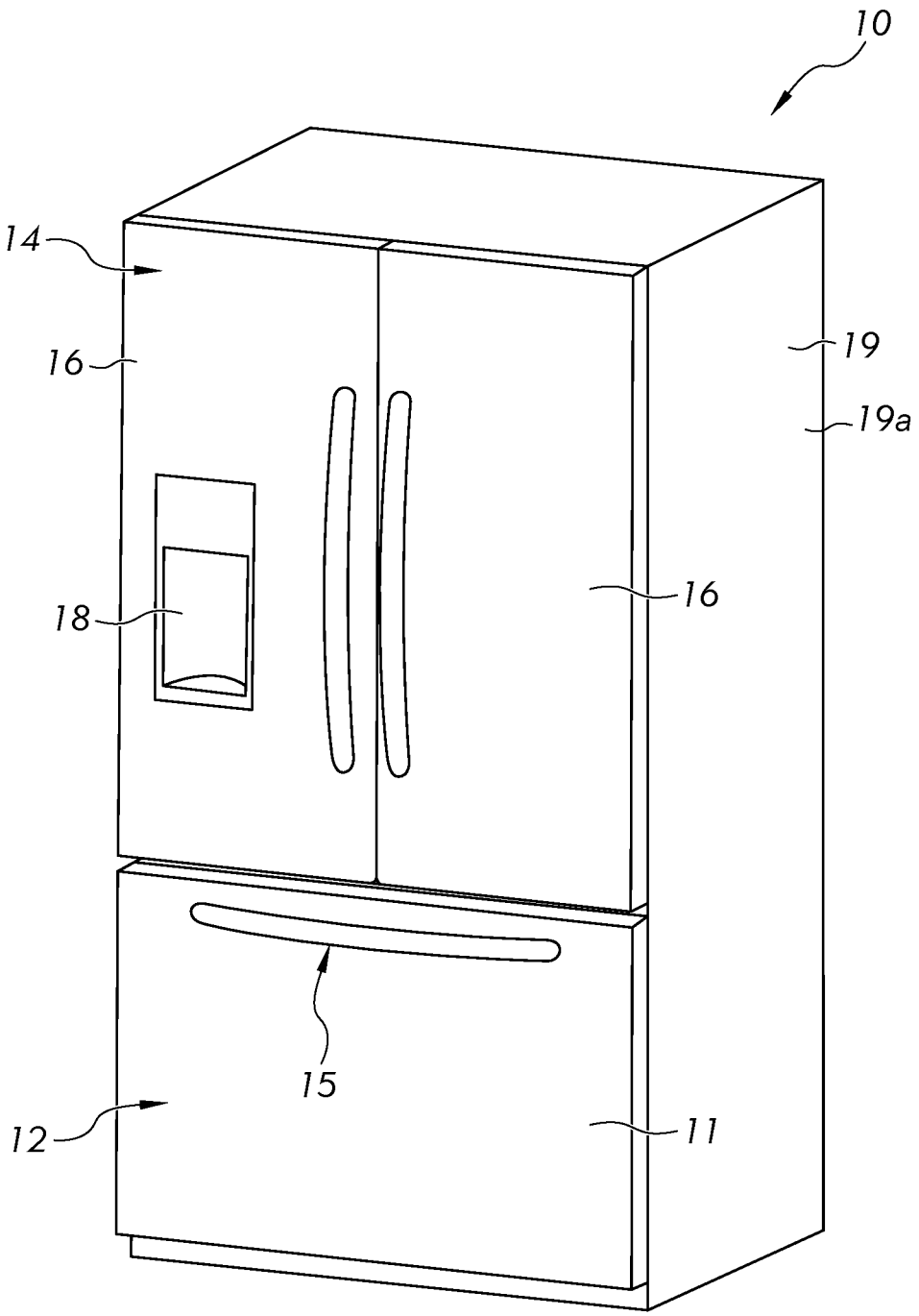
FIG. 1 is a front perspective view of a household French Door Bottom Mount refrigerator wherein doors of the refrigerator are in a closed position.

Apparatus will now be described more fully hereinafter with reference to the accompanying drawings in which embodiments of the disclosure are shown. Whenever possible, the same reference numerals are used throughout the drawings to refer to the same or like parts. However, this disclosure may be embodied in many different forms and should not be construed as limited to the embodiments set forth herein.

Referring now to the drawings, FIG. 1 shows a refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh food storage compartment 14 disposed vertically above a lower freezer storage compartment 12. However, the refrigerator 10 can have any desired configuration including at least one of a fresh food storage compartment 14 and/or a freezer storage compartment 12 (a top mount refrigerator with the freezer located above the fresh food compartment, a side-by-side refrigerator with the freezer located laterally next to the fresh food compartment, a single compartment refrigerator without a freezer compartment, etc.).

One or more doors 16 shown in FIG. 1 are pivotally coupled to a cabinet 19 of the refrigerator 10 to restrict and grant access to the fresh food storage compartment 14. The door 16 can include a single door that spans the entire lateral distance across the entrance to the fresh food storage compartment 14, or can include a pair of French-type doors 16 as shown in FIG. 1 that collectively span the entire lateral distance of the entrance to the fresh food storage compartment 14 to enclose the fresh food storage compartment 14. For the latter configuration, a center flip mullion 21 (FIG. 2) is pivotally coupled to at least one of the doors 16 to establish a surface against which a seal provided to the other one of the doors 16 can seal the entrance to the fresh food storage compartment 14 at a location between opposing side surfaces 17 (FIG. 2) of the doors 16. The mullion 21 can be pivotally coupled to the door 16 to pivot between a first orientation that is substantially parallel to a planar surface of the door 16 when the door 16 is closed, and a different orientation when the door 16 is opened. The externally-exposed surface of the center mullion 21 is substantially parallel to the door 16 when the center mullion 21 is in the first orientation, and forms an angle other than parallel relative to the door 16 when the center mullion 21 is in the second orientation. The seal and the externally-exposed surface of the mullion 21 cooperate approximately midway between the lateral sides of the fresh food storage compartment 14.

A dispenser 18 (FIG. 1) for dispensing ice pieces and water can be provided on an exterior of one of the doors 16 that restricts access to the fresh food storage compartment 14. The dispenser 18 includes an actuator (e.g., lever, switch, proximity sensor, etc.) to cause water or ice pieces to be dispensed therefrom.

The freezer storage compartment 12 is used to freeze and/or maintain articles of food stored in the freezer storage compartment 12 in a frozen condition. For this purpose, the freezer storage compartment 12 is in thermal communication with a freezer evaporator (not shown) and associated blower fan (not shown) that removes thermal energy from the freezer storage compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

Figure 2:
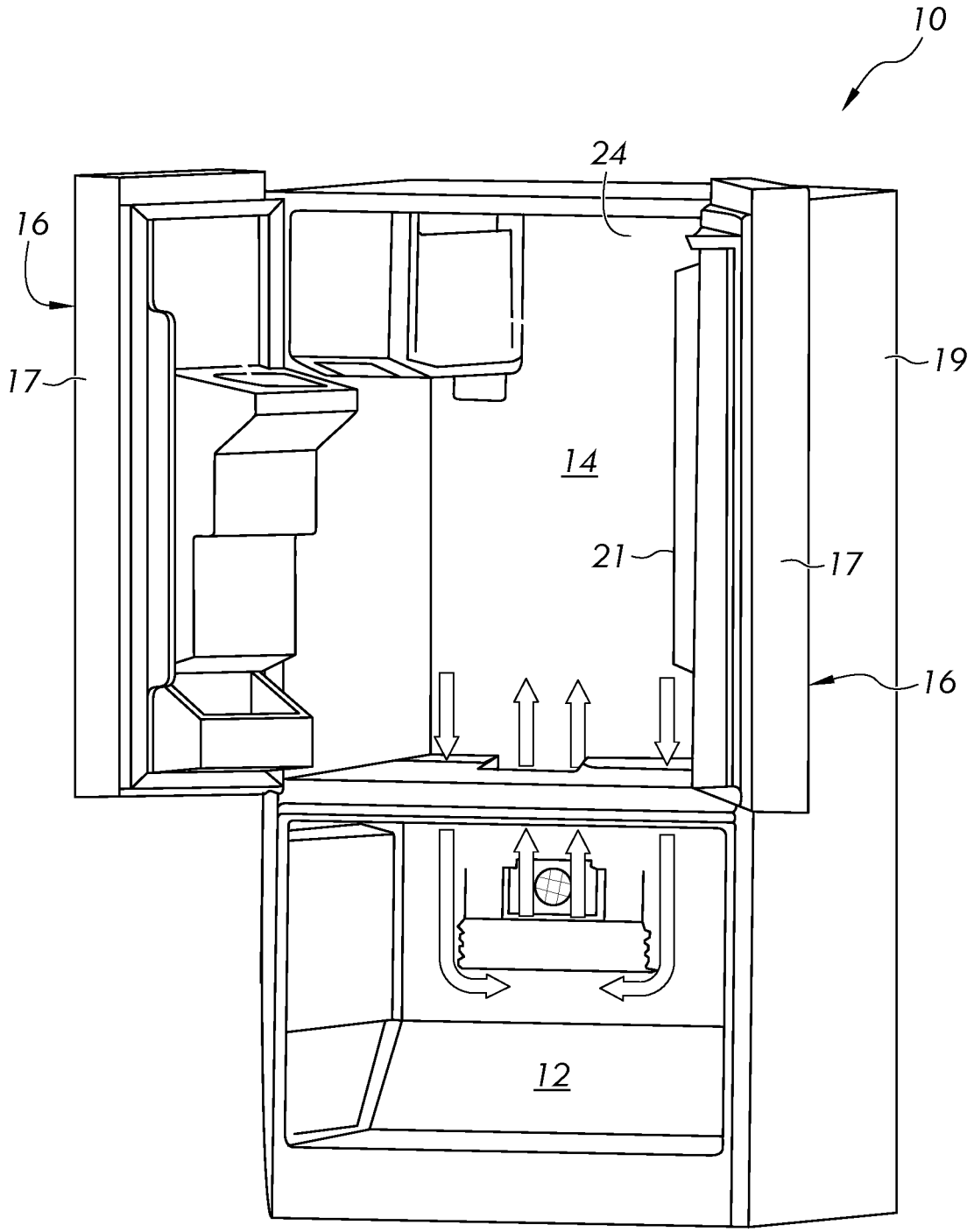
FIG. 2 is a front perspective view of the refrigerator of FIG. 1 showing the doors in an opened position and an interior of a fresh food compartment as well as an interior of a freezer compartment.

Referring to FIGS. 1 and 2, the freezer storage compartment 12 is arranged vertically beneath the fresh food storage compartment 14. The freezer storage compartment 12 may include a freezer door 11 with a handle 15 that is operable to open the freezer door 11 when it is desired to access food items stored in the freezer storage compartment 12.

The refrigerator 10 includes an interior liner 24 (FIG. 2) that defines the fresh food storage compartment 14. The fresh food storage compartment 14 is located in the upper portion of the refrigerator 10 in this example and serves to minimize spoiling of articles of food stored therein. The fresh food storage compartment 14 accomplishes this by maintaining the temperature in the fresh food storage compartment 14 at a cool temperature that is typically above 0° C., so as not to freeze the articles of food in the fresh food storage compartment 14. It is contemplated that the cool temperature preferably is between 0° C. and 10° C., more preferably between 0° C. and 5° C. and even more preferably between 0.25° C. and 4.5° C. According to some embodiments, cool air from which thermal energy has been removed by the freezer evaporator can also be blown into the fresh food storage compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food storage compartment 14 independent of the freezer storage compartment 12. According to an embodiment, the temperature in the fresh food storage compartment 14 can be maintained at a cool temperature within a close tolerance of a range between 0° C. and 4.5° C., including any subranges and any individual temperatures falling with that range. For example, other embodiments can optionally maintain the cool temperature within the fresh food storage compartment 14 within a reasonably close tolerance of a temperature between 0.25° C. and 4° C.

Figure 3:
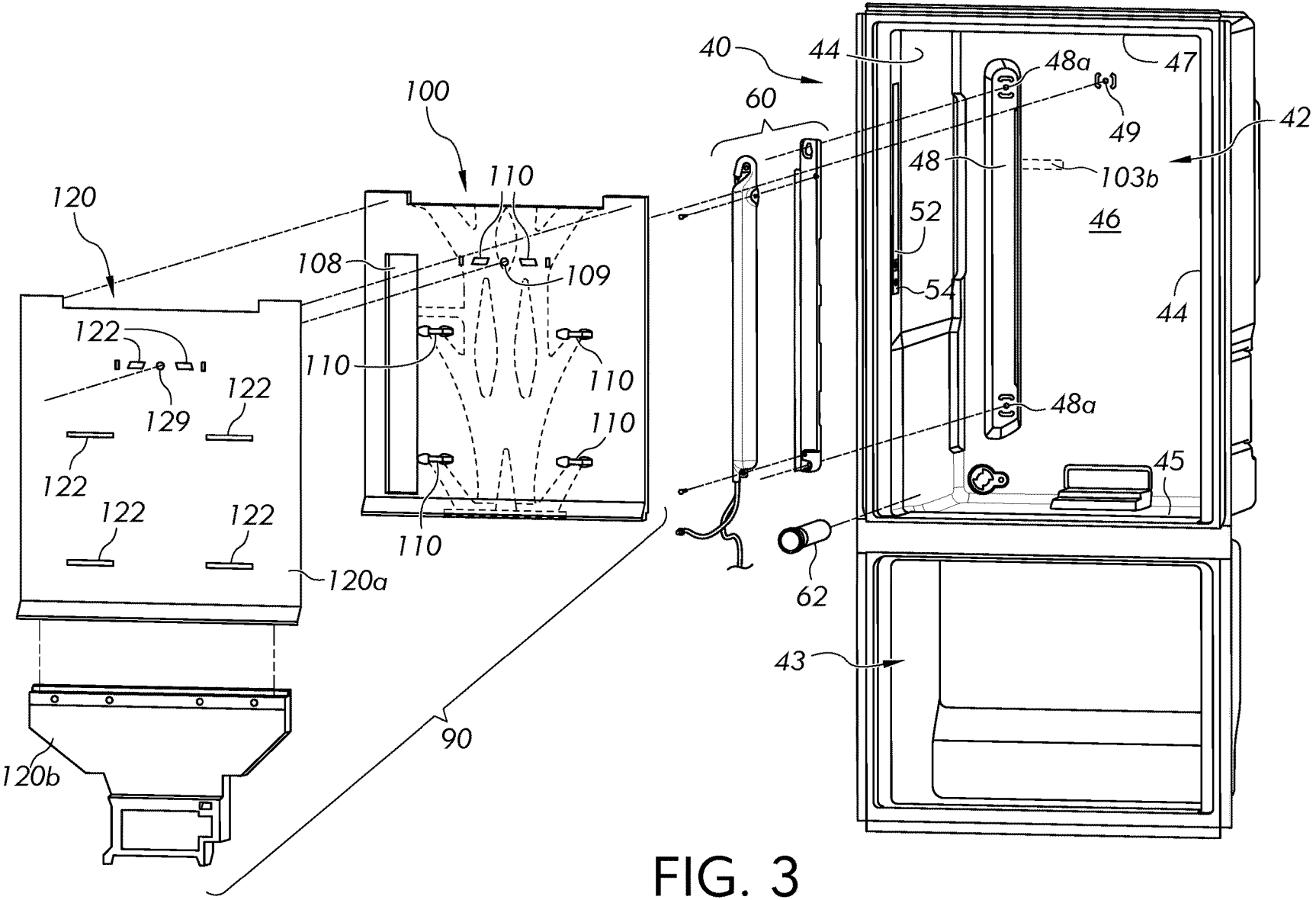
FIG. 3 is an exploded perspective view of an example air tower assembly and water tank assembly shown in relation to an interior liner of a refrigerator appliance according to another embodiment.

Referring to FIG. 3, an interior liner 40 according to another embodiment is shown in relation to an example air tower assembly 90. The interior liner 40 is placed within an outer wrapper 19*a* (FIG. 1) of the refrigerator appliance and defines an internal fresh food storage compartment 42 disposed vertically above a freezer storage compartment 43. However, it is contemplated that the liner may define other storage compartment configurations, such as an upper freezer storage compartment and a lower fresh food compartment, or a side-by-side configuration.

In general, the various examples of a liner and air tower assembly described herein exemplify an architectural layout that optimizes the space efficiency of a refrigerator appliance.

In the illustrated examples, the liner 40 is shown in isolation without other features of the appliance for ease of illustration (e.g., without the outer wrapper, doors, machine compartment, ice maker, etc.).

Figure 4B:
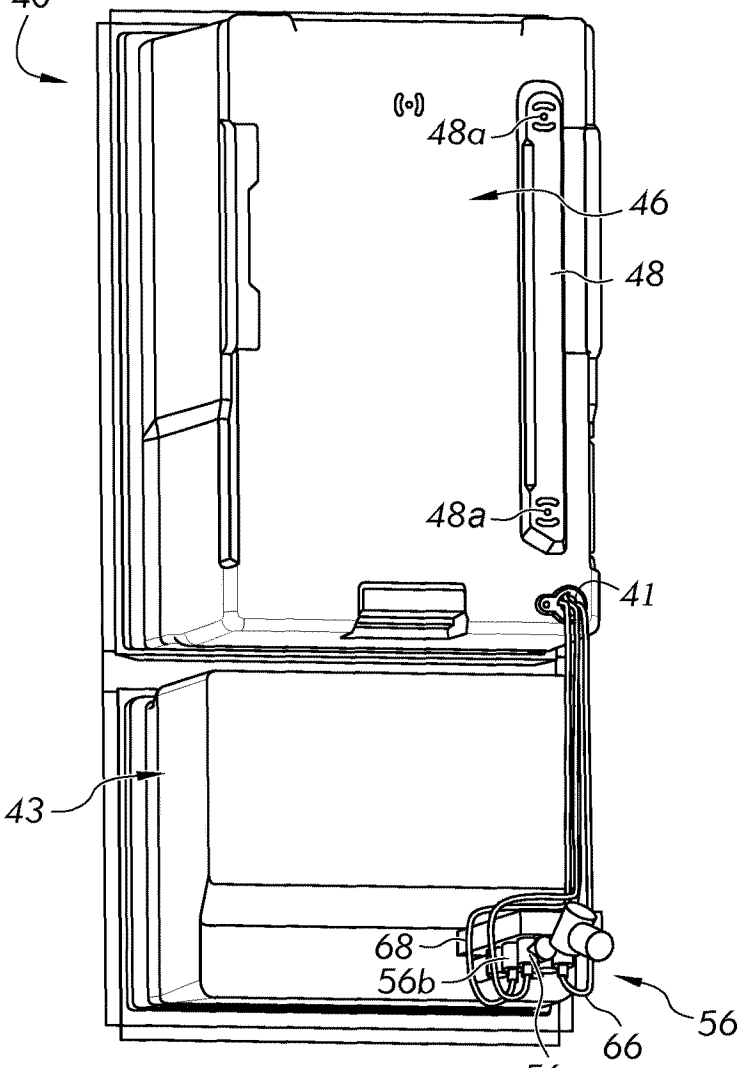
FIG. 4B is an enlarged rear view of the interior liner of FIG. 3 shown in relation to an example valve assembly.
Figure 4A:
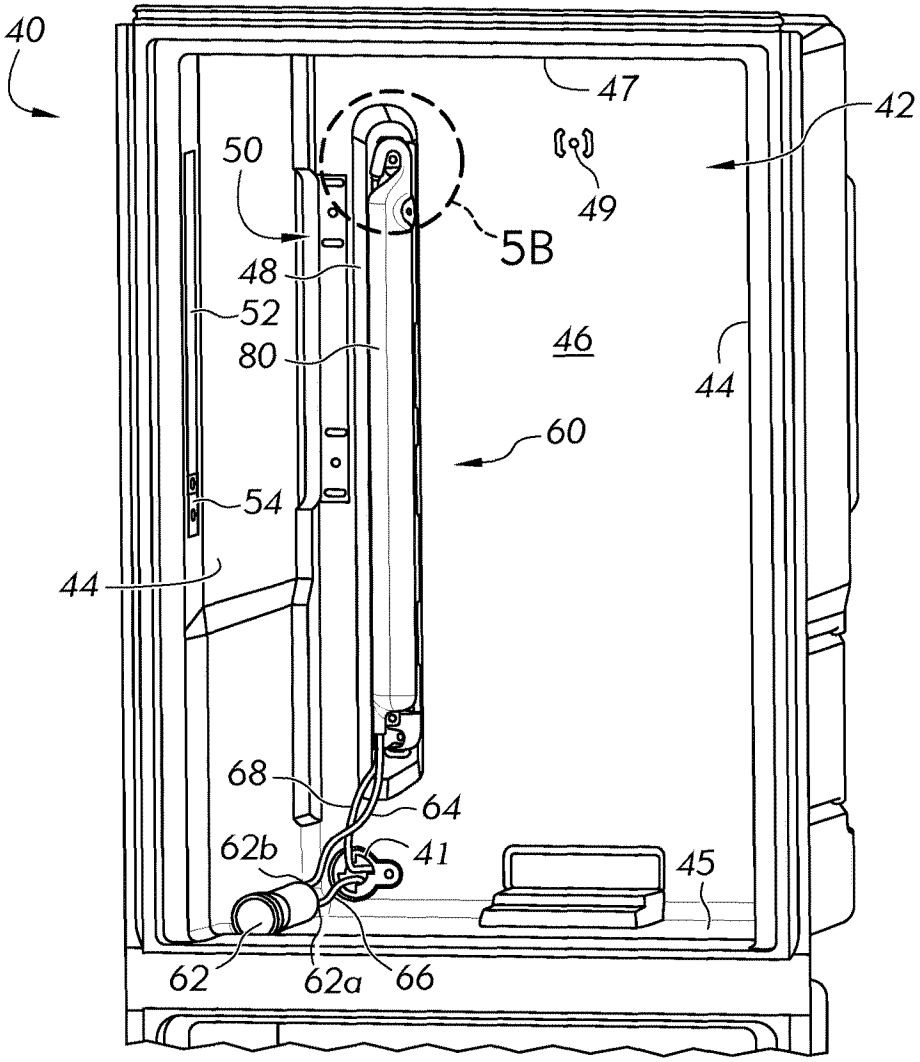
FIG. 4A is an enlarged, partial front view of the interior liner of FIG. 3.

With reference to FIGS. 3 and 4A, the liner 40 includes opposing side walls 44, a bottom wall 45, a rear wall 46, and a top wall 47 or ceiling that collectively bound the fresh food storage compartment 42. A recess 48 is integrally formed in the rear wall 46 and is shaped and dimensioned to accommodate a water tank assembly 60 (FIG. 4A) therein. In the illustrated embodiment, the recess 48 extends vertically and is positioned adjacent to a shelf support mount 50 (FIG. 4A) in the rear wall 46.

As shown in FIG. 3, the recess 48 defines a pair of openings 48*a* dimensioned to receive removable fasteners (e.g., 91 in FIG. 5B) for securing the water tank assembly 60 to the liner 40, as discussed in detail below. In other embodiments, it is contemplated that the recess 48 may be formed horizontally, at an angle, or in another portion of the liner 40, for example in a side wall 44 or in a top wall 47 thereof.

With reference to FIGS. 3 and 4A, the rear wall 46 may also define one or more openings (e.g., 49) for receiving removable fasteners that are extended through corresponding openings 109 and 129 in the air tower assembly 90 (FIG. 3) for securing the air tower assembly 90 to the liner 40.

With reference to FIGS. 4A and 4B, one of the side walls 44 may include a dispenser 52 operable to supply potable water into a glass or beverage container (not shown) placed against the dispenser 52. Specifically, the dispenser 52 may include an actuator or paddle 54 operatively connected to an electrical switch (e.g., a normally closed switch—not shown) configured to open a valve 56*a* (FIG. 4B) in a valve assembly 56 (FIG. 4B) located in a lower rear corner of the appliance, e.g., beneath/outside the freezer storage compartment 43 as shown. In this manner, operating or depressing the paddle 54 will open the valve 56*a* (FIG. 4B), thereby fluidly connecting the dispenser 52 to the water tank assembly 60, i.e., opening the flow path therebetween.

In some embodiments, it is contemplated that a door mounted dispenser 18 (FIG. 1) may be operatively connected to the valve 56*a* (FIG. 4B) to fluidly connect the dispenser 18 (FIG. 1) to the water tank assembly 60.

Referring to FIG. 4A, a water filter assembly 62 is disposed horizontally adjacent to the side wall 44 and the bottom wall 45 in the vicinity of the water tank assembly 60. In use, the water filter assembly 62 is configured to neutralize/absorb contaminants in water supplied to the water tank assembly 60 from an external water source (not shown).

The water filter assembly 62 includes an inlet 62*a* and an outlet 62*b*. The inlet 62*a* is fluidly connected to a water line 66 extending from the valve assembly 56 (FIG. 4B) through an opening 41 in the rear wall 46, and the outlet 62*b* is fluidly connected to another water line 64 extending to and connected to the water tank assembly 60. In the illustrated embodiments, the water lines 64 and 66 embody seamless tubing or conduits fluidly connecting the valve assembly 56, the water filter assembly 62, and the water tank assembly 60.

Figure 5A:
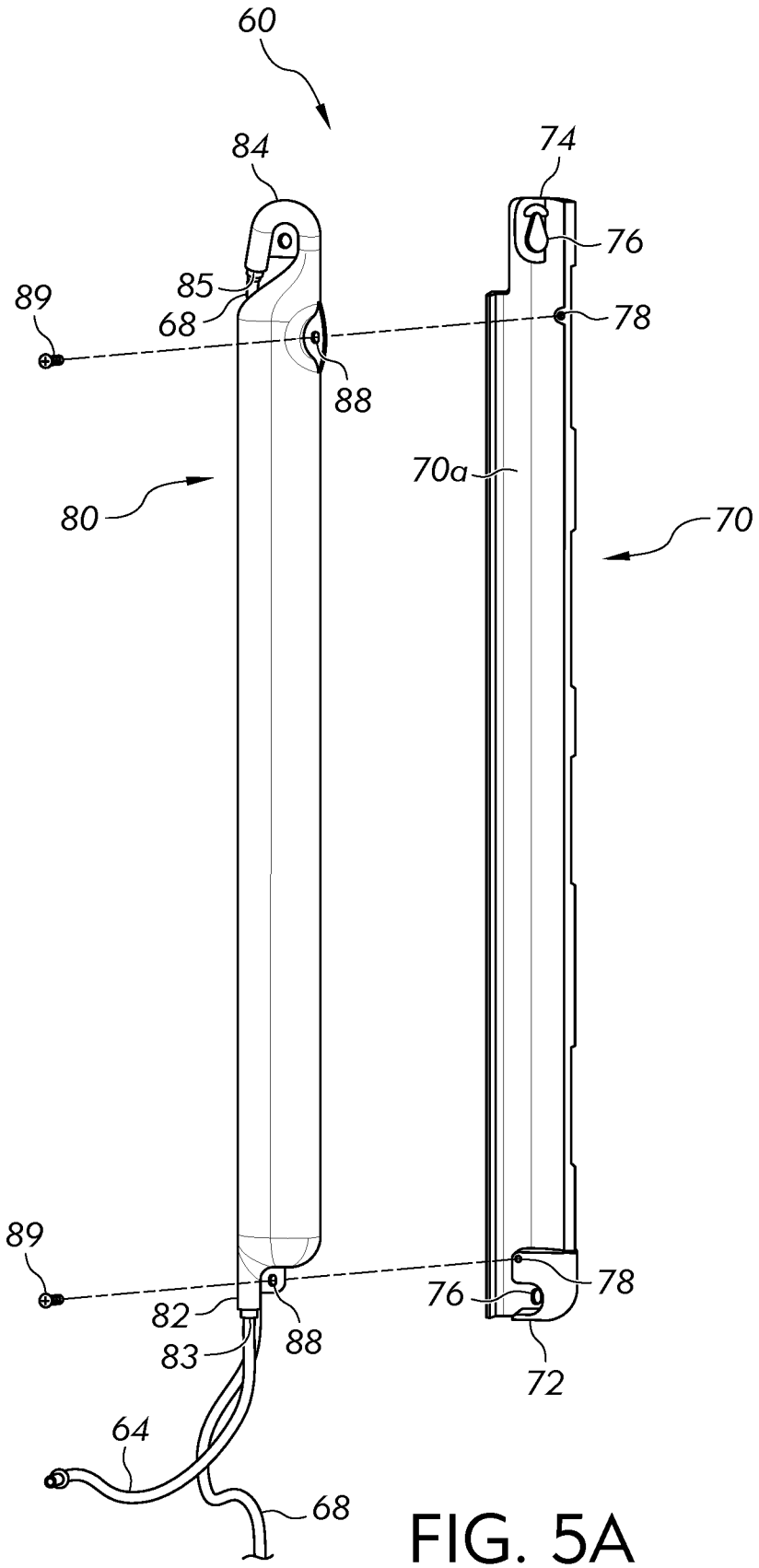
FIG. 5A is an enlarged, exploded perspective view of an example water tank assembly.

With reference to FIG. 5A, the water tank assembly 60 includes a mounting bracket 70 and a water tank 80. The mounting bracket 70 is depicted as an elongated element defining a depression 70*a* that is shaped and dimensioned to partially receive the water tank 80 therein. As shown, the depression 70*a* may have a concaved surface that dimensionally corresponds to an external contour of the water tank 80 to allow the water tank 80 to rest against the mounting bracket 70 in a form-fitting manner.

Figure 5B:
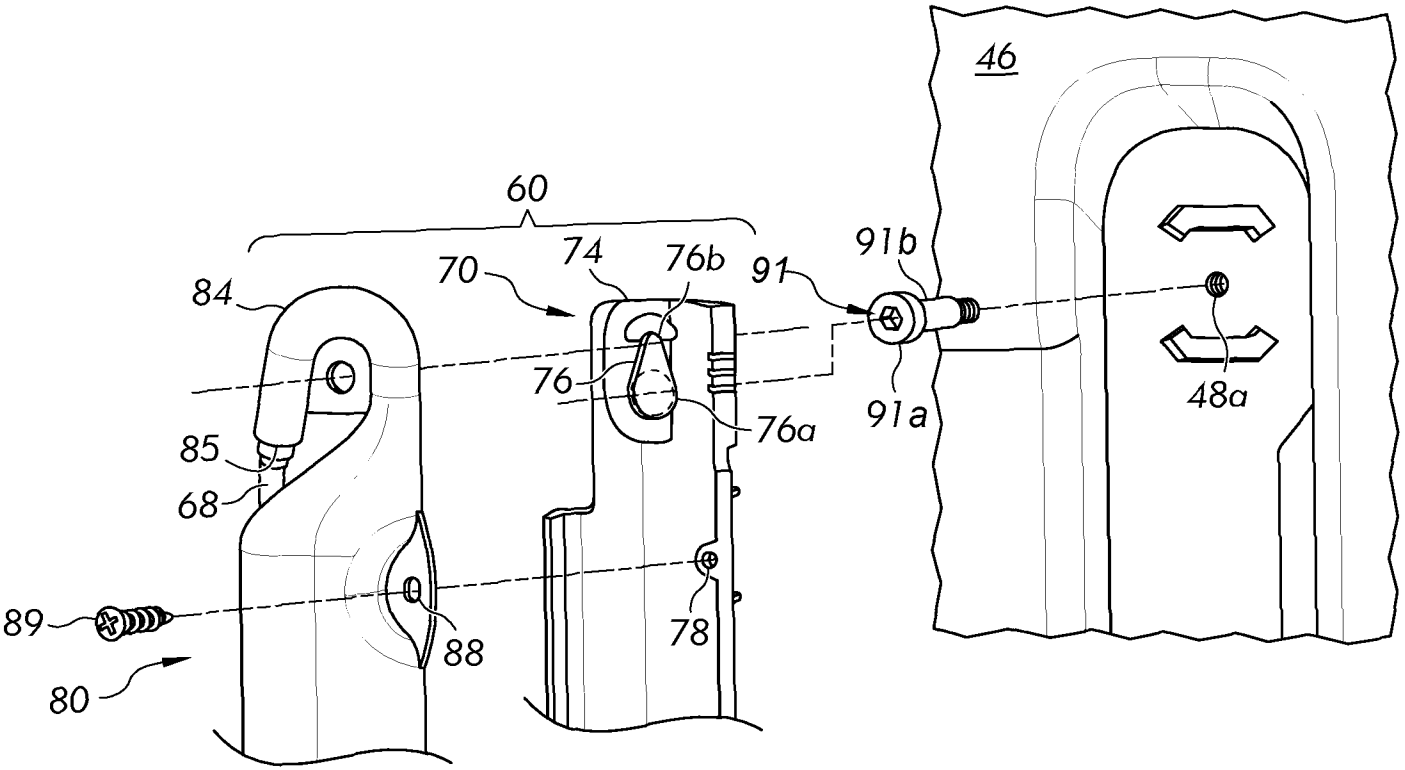
FIG. 5B is closeup, exploded view of the area bounded by dashed lines in FIG. 4A.

The mounting bracket 70 includes a first end 72 and a second end 74, each defining a first opening 76 dimensioned to receive a fastener (e.g., 91 in FIG. 5B) extended into the respective opening 48*a* (FIG. 5B) of the liner 40 to secure the water tank assembly 60 thereto. Referring to FIG. 5B, in a preferred embodiment, the fastener is a shoulder screw 91 that is pre-assembled into the liner opening 48*a* adjacent to the second end 74 of the mounting bracket 70. In this embodiment, the shoulder screw 91 embodies a form of a retention element that is configured to suspend the mounting bracket 70 (and hence the entire water tank assembly) therefrom, for example, by extending the head 91*a* of the shoulder screw 91 through the enlarged portion 76*a* of the first opening 76 and dropping the water tank assembly 60 such that it is suspended via the engagement between the unthreaded shoulder 91*b* of the screw 91 and an upper end 76*b* of the first opening 76. This aspect of the present disclosure makes it easy to install the water tank assembly 60, for example, by hanging or suspending the second end 74 (e.g., an upper end as shown) of the mounting bracket 70 from the shoulder screw 91 and then securing the first end 72 (e.g., the lower end shown in FIG. 6A) to the liner 40 with a separate fastener, e.g., without having to hold the water tank assembly 60 against the liner 40 when fastening the mounting bracket 70 thereto.

While the illustrated embodiment depicts a shoulder screw as retention element for suspending the water tank assembly therefrom, it is contemplated that other forms of retention elements may be utilized for achieving this function, for example, a hanger, a resilient clip or snap, etc.

Referring to FIG. 5A, the mounting bracket 70 may define a pair of second openings 78 in the vicinity of the first openings 76. The second openings 78 are dimensioned to receive fasteners 89 that are extended through mating openings 88 of the water tank 80 for securing the water tank 80 to the mounting bracket 70. In other embodiments, it is contemplated that the mounting bracket 70 may include other elements (e.g., resilient snaps, clips, slots, etc.) for securing the water tank 80 thereto.

The water tank 80 resembles an elongated cylinder including a first end 82 and a second end 84. An inlet 83 is formed at the first end 82 for receiving a water line 64 connected to the outlet 62*b* (FIG. 4A) of the water filter assembly 62. An outlet 85 is formed at the second end 84 for receiving a water line 68 connected to a valve 56*b* (FIG. 4B) of the valve assembly 56. It is contemplated that the water lines 64 and 68 may comprise seamless tubing. It is also contemplated that the lines 64 and 68 may be respectively overmolded to the inlet 83 and the outlet 85 of the water tank 80 during injection molding, for example, in those embodiments wherein the tank 80 is made of plastic.

Still referring to FIG. 5A, the water tank 80 also defines a pair of mating openings 88 corresponding to the respective second openings 78 of the mounting bracket 70. Fasteners 89 are extended through the mating openings 88 and through the second openings 78 of the mounting bracket 70 to secure the water tank 80 to the mounting bracket 70. In other embodiments, it is contemplated that the water tank 80 may include other elements (e.g., resilient snaps, clips, slots, etc.) for securing the water tank 80 to the mounting bracket 70.

In the illustrated embodiments, the inlet 83 is disposed at the first end 82, and the outlet 85 is disposed at the second end 84, although this may be reversed. In other embodiments, it is contemplated that the water tank 80 may be oriented horizontally instead of vertically, for example, in those embodiments wherein the recess 48 extends horizontally or at another angle.

In some embodiments, the mounting bracket 70 and the water tank 80 form part of a subassembly that is mounted in the recess 48 and secured to the rear wall 46 of the liner 40 during product assembly. In other embodiments, it is contemplated that the water tank 80 may include features (e.g., slots, openings, a hanger, clips, resilient snaps, etc.) for attaching the water tank 80 directly to the liner 40, i.e., without a mounting bracket therefor.

Turning back to FIG. 3, an example air tower assembly 90 is shown in relation to the liner 40. Distinctively, the air tower assembly 90 and the liner 40 form part of an architectural layout that optimizes the space efficiency (e.g., usable space) within the appliance by accommodating the water tank assembly 60 (FIG. 5) in an area laterally outside the air plenum of the air tower assembly 90, as discussed in detail below. In the illustrated example, the air tower assembly extends substantially over an entire width of the rear wall 46. Although in other embodiments, it is to be appreciated that the air tower assembly may extend less than an entire width of the rear wall, as discussed in detail below.

Figure 6:
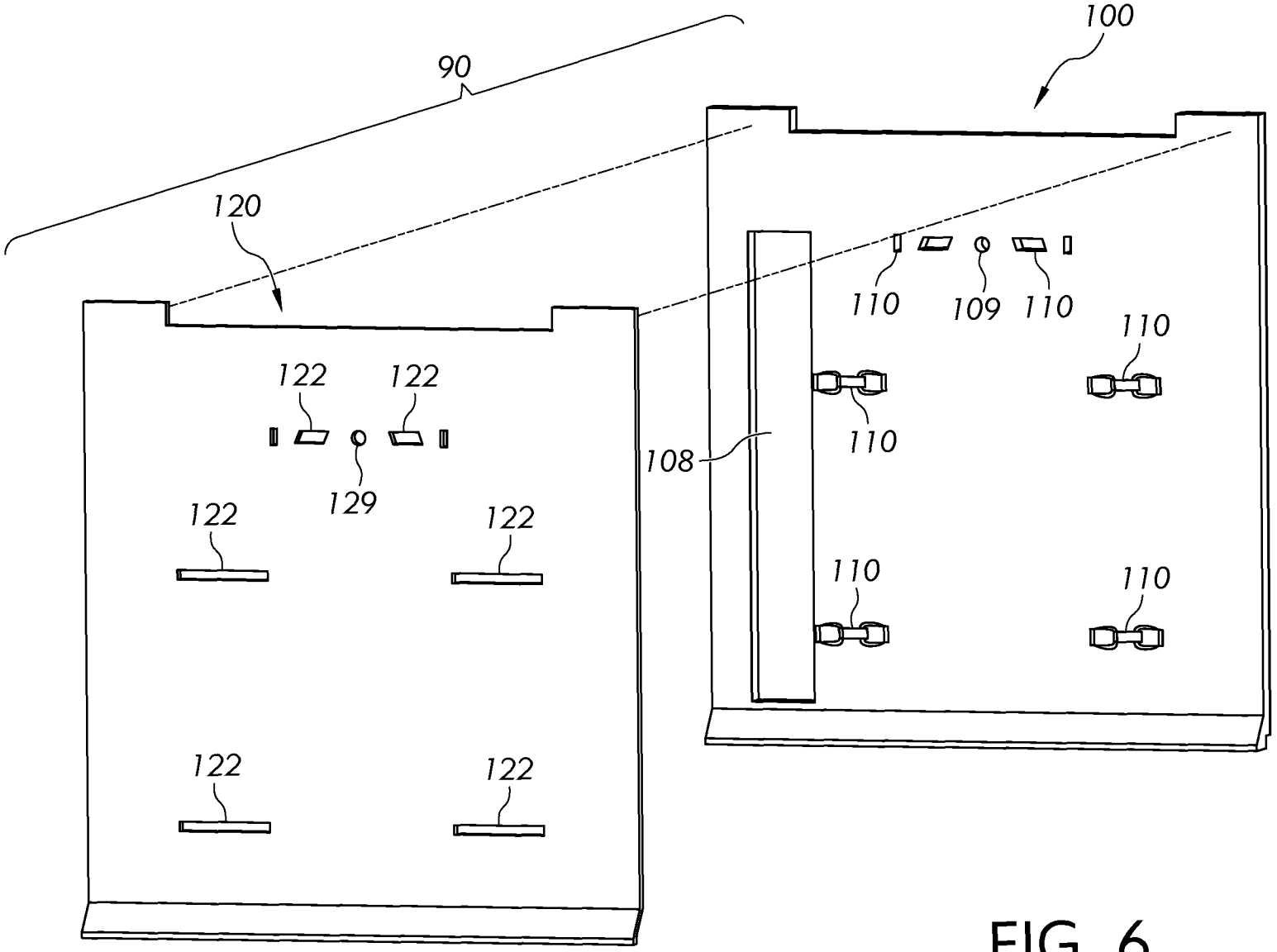
FIG. 6 is an enlarged exploded view of the air tower assembly of FIG. 3.

With reference to FIG. 6, the air tower assembly 90 includes insulation 100 and an air tower cover 120 disposed about the insulation 100. In a preferred embodiment, the insulation is a rigid piece of EPS foam, and the air tower cover 120 is made of plastic or metal. In addition, the insulation 100 and the air tower cover 120 preferably form part of a subassembly that is secured to the rear wall 46 (FIG. 3) via fasteners (not shown) extended into openings (e.g., 109 and 129) thereof.

In use, the insulation 100 is configured to inhibit heat transfer between the fresh food compartment 42 (FIG. 3) and the surrounding environment. While a rigid piece of foam insulation 100 is shown, it is contemplated that the insulation 100 may also comprise vacuum insulated panels (VIPs) to increase the insulation performance (e.g., the R-value per square foot) of the insulation 100 and decrease the total amount of insulation required, e.g., to decrease the thickness thereof. The use of VIPs may also be beneficial for providing localized insulation as needed.

Figure 7:
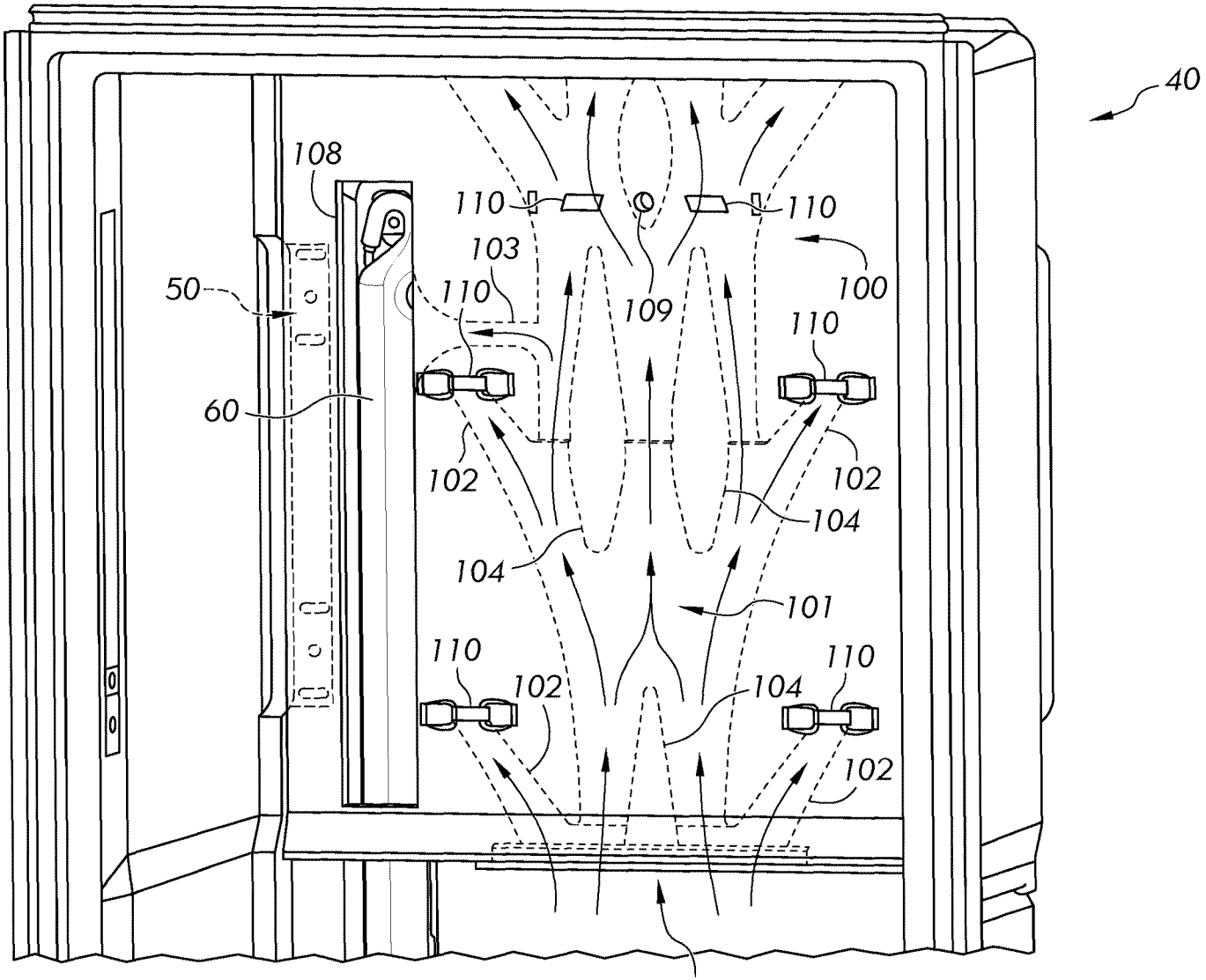
FIG. 7 is an enlarged perspective view of an example insulation and air plenum disposed about the interior liner of FIG. 3A.

Referring to FIG. 7, the insulation 100 is shown disposed about the liner 40 with hidden features made visible via dashed lines. In the illustrated embodiment, the insulation 100 defines a central air plenum 101 comprising a plurality of channels 102 configured to direct cold air entering an inlet 101*a* thereof towards exhaust openings 110 in the insulation 100.

The insulation 100 may also define one or more baffles 104 configured to direct cold air towards the respective openings 110 thereof. In use, a flow of cold air generated by an evaporator fan (not shown) in the freezer compartment 43 (FIG. 3) enters the inlet 101*a*, whereupon the air is directed towards and through the central air plenum 101 and eventually exhausted out the openings 110. In some embodiments, the air plenum 101 may optionally define one or more channels 103 for directing a minor portion of the cold air toward the water tank 80 to increase the rate at which water therein is cooled. Yet, in other embodiments, it is contemplated that the liner 40 may partially or fully define a channel (e.g., 103*b* in FIG. 3) for directing cold air toward the water tank 80, for example, in such embodiments wherein the air tower assembly is dimensioned to span less than an entire width of the rear wall 46 (FIG. 3) and/or is disposed laterally or next to the recess 48 (FIG. 3) in the rear wall 46, for example, to the right of the recess in the embodiment shown. In such embodiments, it is contemplated that the channel 103 in the insulation and/or the channel 103*b* in the liner may be positioned to direct cold air toward the water tank 80. It is also contemplated that a rigid structure (e.g., a conduit, tube, and the like) may be disposed in either or both of the channels 103 (FIG. 7) and 103*b* (FIG. 3) and/or in the insulation for directing cold air toward the water tank 80. In this manner, it should be understood that a wide variety of arrangements are contemplated for directing cold air toward the water tank 80.

In the illustrated embodiment, the air channels 102 generally extend vertically towards six different openings 110 which are spaced about the interior of the fresh food compartment. It is contemplated that the orientation and the number of air channels 102 may differ from that which is shown without departing from the scope of the present disclosure.

In addition, the insulation 100 defines an opening 108 dimensioned to align with the recess 48 (FIG. 3) of the liner 40. The opening 108 is located in between the central air plenum 101 and the shelf support mount 50 and is dimensioned to partially receive the water tank assembly 60 therein. In other embodiments, the insulation may not define an opening, for example, in those embodiments where the air tower assembly spans less than an entire width of the rear wall or is disposed laterally or next to the water tank assembly, e.g., to the right of the water tank assembly 60 and the recess 48 (FIG. 3). One or more openings (e.g., 109) may also be formed in the insulation 100 for receiving one or more fasteners therethrough for securing the air tower assembly 90 to the liner 40. Preferably, the opening 108 is a through opening that extends entirely through the insulation 100. More preferably, the opening 108 circumscribes the water tank assembly 60 so as to provide an insulating effect thereto and prevent freezing of water contained within the water tank.

Figure 8:
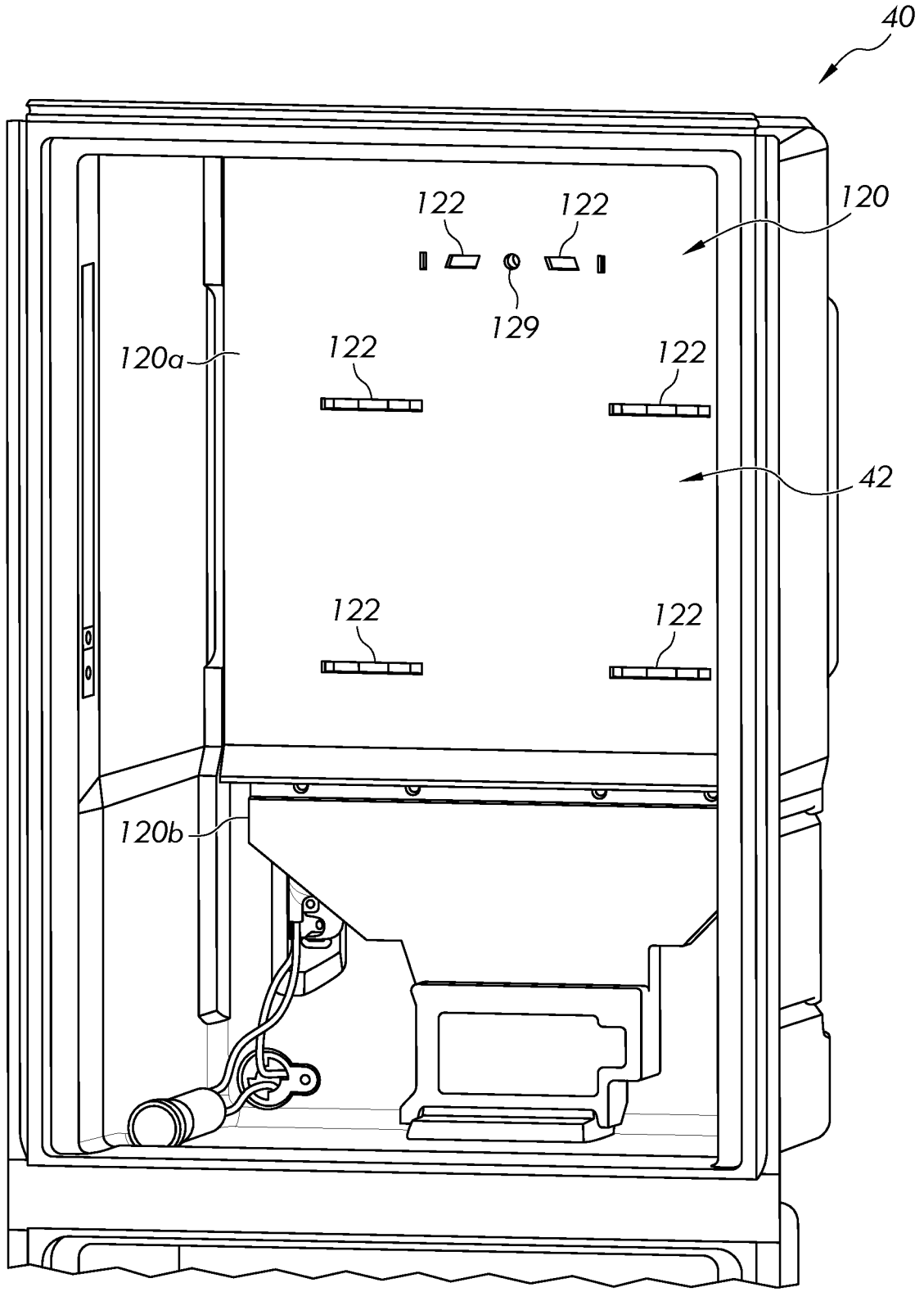
FIG. 8 is an enlarged perspective view of an example air tower cover enclosing the foam insulation of FIG. 7.

Referring to FIG. 8, the air tower cover 120 is disposed in a covering relationship over the insulation 100 (FIG. 7) and defines a plurality of openings 122 correspondingly aligned with the openings 110 (FIG. 7) of the insulation 100. In use, the openings 122 define exhaust air outlets of the air tower assembly 90. Specifically, cold air flowing (FIG. 7) through the central air plenum 101 is directed through the openings 122 (via the openings 110 (FIG. 7) of the insulation 100) to cool the fresh food compartment 42. In addition, one or more other openings (e.g., 129) may be formed in the air tower cover 120 for receiving fasteners therethrough that are extended through the other openings (e.g., 109 in FIG. 7) of the insulation 100, and into the corresponding openings (e.g., 49 in FIG. 3) of the liner 40, respectively, for securing the air tower assembly 90 (FIG. 3) to the liner 40.

As shown in FIG. 8, the air tower cover 120 also serves to conceal the water tank assembly 60 and the insulation 100 thereunder. In this manner, the air tower cover 120 enhances the aesthetic appearance of the fresh food compartment 42 by making it more pleasing in fit and finish. In the illustrated embodiment, the air tower cover 120 includes an upper and a lower cover 120*a* and 120*b*. In other embodiments, it is contemplated that the air tower cover 120 may embody a unitary structure. It is also contemplated that a separate cover may conceal the water tank assembly, for example, in those embodiments wherein the air tower assembly is disposed laterally or next to the water tank assembly. In such embodiments, the separate cover may define one or more openings therethrough for fluidly communicating with the cold air of the fresh food compartment to cool the water tank.

As noted above, the air tower assembly 90 and the liner 40 form part of an architectural layout that optimizes the space efficiency of the appliance. Specifically, with reference to FIG. 3, the recess 48 in the liner 40 and the opening 108 in the insulation 100 enable the water tank assembly 60 to be arranged within a space generally occupied by (or reserved for) the air tower assembly 90 (i.e., the space disposed laterally outside of the central plenum 101 (FIG. 7) without affecting the cooling function of the air tower assembly 90. In addition, the location of the valve assembly 56 (FIG. 4B) on the rear corner of the appliance helps minimize the total space required to accommodate the water tank assembly 60. This is in distinction to designs featuring a tank and valve subassembly which dimensionally require a larger space therefor.

Figure 9A:
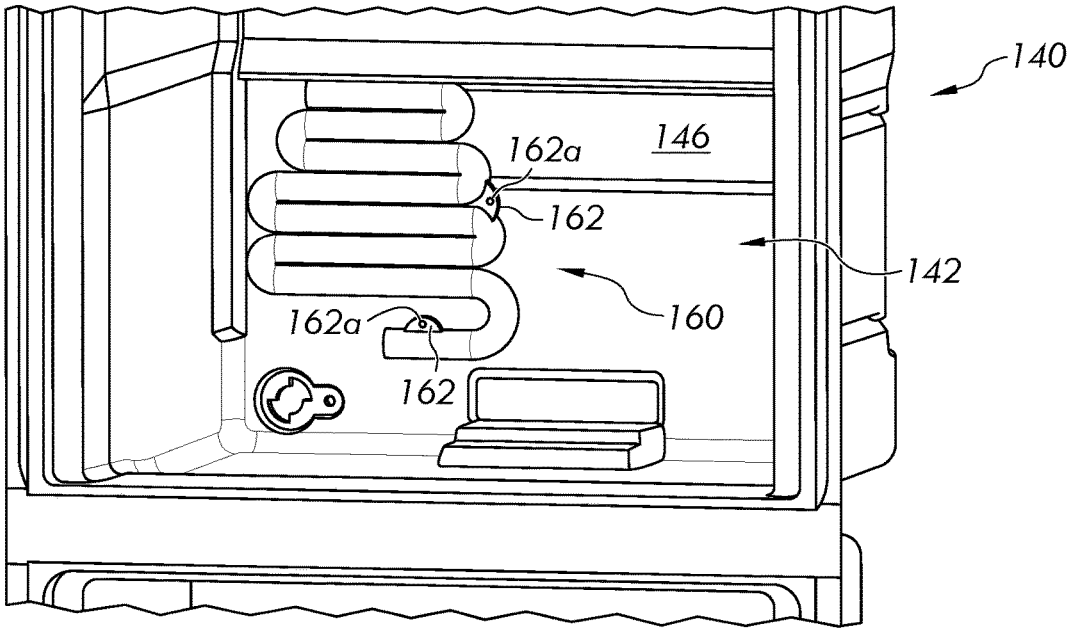
FIG. 9A is a partial perspective front view of an interior liner with another example water tank assembly according to another embodiment.
Figure 9B:
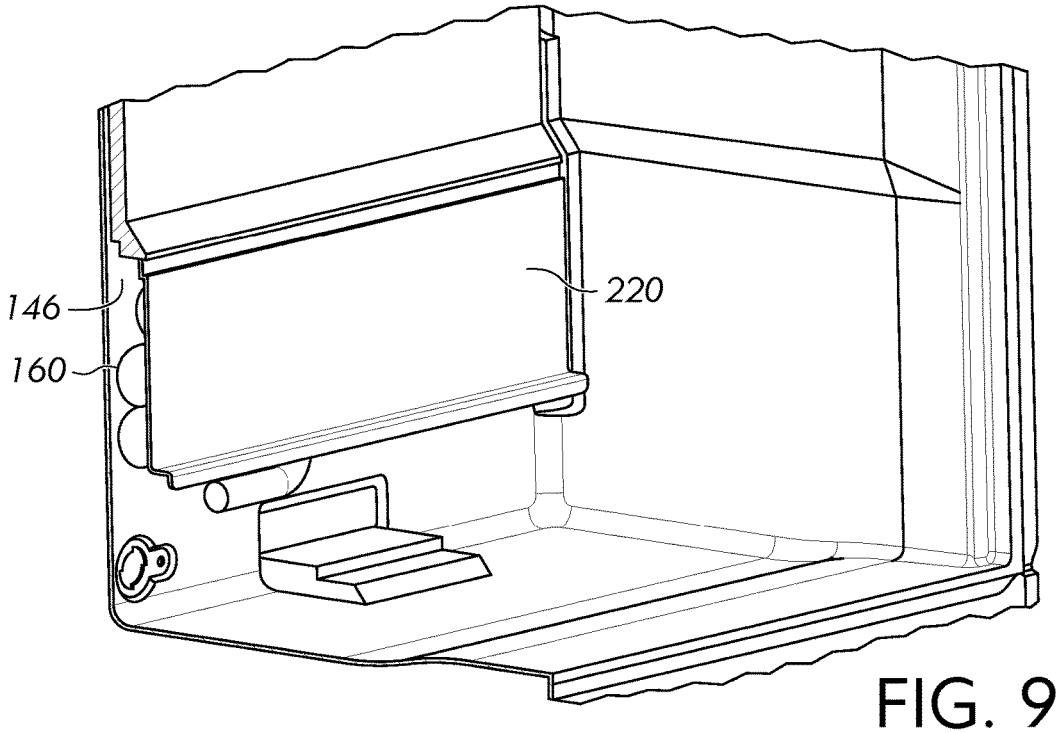
FIG. 9B is another partial perspective front view of the water tank assembly of the interior liner of FIG. 9A shown in relation to the water tank assembly concealed by an example cover plate.

Referring now to FIG. 9A, another example of a liner 140 for a fresh food compartment 142 is shown. In distinction to the first embodiment, this liner 140 is devoid of a recess for accommodating a water tank assembly therein. Instead, the water tank 160 (shown as a serpentine-style configuration) is disposed in an area between a rear liner wall 146 (FIG. 9B) and a cover plate, which may be an air tower cover 220 or may be separate from an air tower. It is contemplated that the water tank 160 may be secured to the liner (to the rear liner wall 146) via fasteners extended through openings 162*a* in one or more molded tabs (e.g., 162) formed on the water tank 160.

In summary, the architectural layouts according to the various inventions described herein effectively optimize the space efficiency of the appliance by decreasing the dimensional footprint of the water tank assembly, and by accommodating the water tank assembly in a space generally reserved for the refrigerator's air tower assembly. While the various inventions disclosed herein have been described with reference to the example embodiments described above, it should be understood that modifications and alterations will occur to others upon a reading and understanding of this specification without departing from the spirit and scope of the invention set forth in the appended claims. Example embodiments incorporating one or more aspects of the invention are intended to include all such modifications and alterations insofar as they come within the scope of the appended claims and their equivalents.

Moreover, it should be understood that the order of discussion is not limiting and is only provided for ease of describing the various examples of a refrigerator interior layout disclosed herein. Similarly, the positions (e.g., upper, lower) described herein are provided for ease of disclosing the illustrated embodiments. In this manner, it should be appreciated that positions would be different in other embodiments without departing from the scope of the present disclosure.

What is claimed is:

1. A refrigerator appliance comprising:

a liner bounding a storage compartment and defining a recess;

an air tower assembly including insulation and a cover, wherein the insulation is disposed about the liner and defines an air plenum therein, wherein the insulation is located between the cover and the recess;

a dispenser for selectively dispensing water; and a water tank assembly mounted in the recess and adapted to supply water to the dispenser, wherein the air plenum defines a channel therein in fluid communication with the recess and configured to direct air toward the water tank assembly, wherein the insulation defines an opening therethrough, said air plenum in fluid communication with the opening and configured to direct air through the opening to cool the storage compartment, and wherein the water tank assembly is disposed laterally outside of the air plenum and enclosed by the cover of the air tower assembly and the liner.

2. The refrigerator appliance according to claim 1, wherein the liner comprises a rear wall, a first side wall, and a second side wall, wherein the recess is integrally formed in the rear wall and located between the air plenum and one of the first side wall and the second side wall.

3. The refrigerator appliance according to claim 2, wherein the liner comprises a shelf support mount proximate to one of the first side wall and the second side wall, and wherein the recess is formed in between the air plenum and the shelf support mount.

4. The refrigerator appliance according to claim 1, wherein the insulation defines an opening therethrough, said opening dimensioned to at least partially receive the water tank assembly therein.

5. The refrigerator appliance according to claim 1, wherein the liner comprises a retention element and wherein the water tank assembly comprises:

a water tank and a mounting bracket, wherein the mounting bracket defines a depression dimensioned to accommodate an external contour of the water tank, wherein the mounting bracket further defines an opening dimensioned to receive the retention element therethrough for suspending the water tank assembly from the liner.

6. A refrigerator appliance comprising:

a liner defining a first storage compartment and a second storage compartment, wherein the first storage compartment is bounded by a rear wall, a first side wall, and a second side wall, wherein the rear wall defines a recess therein;

an air tower assembly including foam insulation and a cover, wherein the foam insulation is disposed about the rear wall and defines a first opening therethrough aligned with the recess;

a dispenser attached to one of the first side wall and the second side wall;

a water tank assembly mounted in the recess and at least partially arranged in the first opening of the foam insulation, said water tank assembly adapted to supply water to the dispenser;

a valve assembly disposed outside the second storage compartment; and a water filter assembly arranged in the first storage compartment.

7. The refrigerator appliance according to claim 6, wherein the water tank assembly comprises a water tank, wherein the valve assembly is configured to supply water to the filter assembly, and wherein the filter assembly is configured to supply filtered water to the water tank.

8. The refrigerator appliance according to claim 7, wherein the water tank is configured to supply filtered water to the dispenser via the valve assembly.

9. The refrigerator appliance according to claim 8, wherein the dispenser comprises a paddle operable to selectively supply filtered water to the dispenser.

10. The refrigerator appliance according to claim 6, wherein the foam insulation defines a second opening therethrough and an air plenum therein, said air plenum in fluid communication with the second opening and configured to direct air through the second opening to cool the first storage compartment.

11. The refrigerator appliance according to claim 10, wherein the water tank assembly is disposed laterally outside of the air plenum and enclosed by the cover of the air tower assembly and the liner.

12. The refrigerator appliance according to the claim 10, wherein the air plenum defines a channel in fluid communication with the first opening of the foam insulation and configured to direct air toward the water tank assembly.

13. The refrigerator appliance according to claim 10, wherein the recess is located between the air plenum and one of the first side wall and the second side wall.

14. The refrigerator appliance according to claim 10, wherein the rear wall comprises a shelf support mount proximate to one of the first side wall and the second side wall, and wherein the recess is formed in between the air plenum and the shelf support mount.

15. The refrigerator appliance according to claim 6, wherein the rear wall comprises a retention element and wherein the water tank assembly comprises:

a water tank and a mounting bracket, wherein the mounting bracket defines a depression dimensioned to accommodate an external contour of the water tank, wherein the mounting bracket further defines an opening dimensioned to receive the retention element therethrough for suspending the water tank assembly from the liner.

16. The refrigerator appliance according to claim 15, wherein the mounting bracket defines another opening dimensioned to receive a fastener therethrough for securing the water tank to the mounting bracket.

17. The refrigerator appliance according to claim 6, wherein the valve assembly is connected to the water tank assembly and to the water filter assembly via seamless tubing routed through an opening in the rear wall.

18. A refrigerator appliance comprising:

a liner bounding a storage compartment and defining a recess;

an air tower assembly including insulation and a cover, wherein the insulation is disposed about the liner and defines an opening therethrough aligned with the recess of the liner, wherein the insulation is located between the cover and the recess;

a dispenser for selectively dispensing water; and a water tank assembly mounted in the recess and at least partially arranged in the opening of the insulation, said water tank assembly adapted to supply water to the dispenser.

* * * * *